US009284777B1

(12) United States Patent
Licea et al.

(10) Patent No.: US 9,284,777 B1
(45) Date of Patent: Mar. 15, 2016

(54) FALL RESTRAINT SYSTEM FOR TELESCOPING LADDERS

(71) Applicants: William Licea, Pembroke Pines, FL (US); John Rojas, Miami, FL (US)

(72) Inventors: William Licea, Pembroke Pines, FL (US); John Rojas, Miami, FL (US)

( * ) Notice: Subject to any disclaimer, the term of this patent is extended or adjusted under 35 U.S.C. 154(b) by 0 days.

(21) Appl. No.: 14/507,444

(22) Filed: Oct. 6, 2014

Related U.S. Application Data

(62) Division of application No. 13/536,168, filed on Jun. 28, 2012, now Pat. No. 8,875,839.

(51) Int. Cl.
*E06C 7/18* (2006.01)

(52) U.S. Cl.
CPC ..... *E06C 7/186* (2013.01)

(58) Field of Classification Search
CPC ..... E06C 7/08; E06C 7/18; E06C 7/181; E06C 7/183; E06C 7/186; A62B 35/0043; A62B 99/00
See application file for complete search history.

(56) References Cited

U.S. PATENT DOCUMENTS

| | | | | | |
|---|---|---|---|---|---|
| 304,420 | A | * | 9/1884 | Fox et al. | 182/213 |
| 349,370 | A | * | 9/1886 | Springer | 182/212 |
| 2,616,609 | A | | 11/1952 | Herod | |
| 3,598,200 | A | | 8/1971 | Thompson | |
| 3,779,347 | A | * | 12/1973 | Chevalier | 188/65.2 |
| 4,111,280 | A | | 9/1978 | Devine et al. | |
| 4,252,214 | A | * | 2/1981 | Miller | 182/8 |
| 4,364,451 | A | * | 12/1982 | Wright | 182/213 |
| 4,458,781 | A | | 7/1984 | Ellis et al. | |
| 4,605,100 | A | * | 8/1986 | Inglese | 182/213 |
| 4,811,752 | A | * | 3/1989 | Lyons et al. | 137/77 |
| 5,117,943 | A | * | 6/1992 | Schmitt et al. | 182/213 |
| 5,161,639 | A | | 11/1992 | Ice | |
| 5,265,696 | A | | 11/1993 | Casebolt | |
| 6,161,647 | A | | 12/2000 | Braden et al. | |
| 6,260,662 | B1 | | 7/2001 | Meister et al. | |
| 6,804,830 | B2 | | 10/2004 | Reynolds et al. | |
| 7,600,610 | B2 | * | 10/2009 | Deuer | 182/8 |
| 2002/0014370 | A1 | | 2/2002 | Casebolt et al. | |
| 2006/0130714 | A1 | * | 6/2006 | Jones et al. | 108/106 |
| 2006/0277848 | A1 | * | 12/2006 | Penn | 52/182 |
| 2009/0288913 | A1 | * | 11/2009 | Nielsen | 182/8 |
| 2010/0176254 | A1 | * | 7/2010 | Sweere et al. | 248/123.11 |
| 2010/0219016 | A1 | * | 9/2010 | Meillet | 182/8 |
| 2010/0326768 | A1 | | 12/2010 | Kerstetter, Jr. | |
| 2011/0284323 | A1 | * | 11/2011 | Ayre | 182/5 |

* cited by examiner

*Primary Examiner* — Katherine Mitchell
*Assistant Examiner* — Shiref Mekhaeil
(74) *Attorney, Agent, or Firm* — Albert Bordas, P.A.

(57) ABSTRACT

A fall restraint system having a retractor assembly including a housing assembly that is mounted onto an aerial apparatus. A base pulley assembly is also mounted onto the aerial apparatus. A cable having first and second ends is partially stored within the housing assembly, whereby the first end is fixed within the housing assembly. The second end is threaded around the base pulley assembly and is also fixed onto the aerial apparatus. Tensioning means keep a predetermined tension on the cable while the aerial apparatus extends from a retracted position to an extended position and vice-versa.

15 Claims, 6 Drawing Sheets

FALL RESTRAINT SYSTEM FOR TELESCOPING LADDERS

OTHER RELATED APPLICATIONS

The present application is a continuation of pending U.S. patent application Ser. No. 13/536,168 filed on Jun. 28, 2012, which is hereby incorporated by reference.

BACKGROUND OF THE INVENTION

1. Field of the Invention

The present invention relates to fall restraint systems, and more particularly, to fall restraint systems for telescoping ladders.

2. Description of the Related Art

Firefighters are rescuers extensively trained primarily to extinguish hazardous fires that threaten civilian populations and property, and to rescue people from dangerous incidents, such as collapsed and burning buildings. The increasing complexity of modern industrialized life with an increase in the scale of hazards has created an increase in the skills needed in firefighting technology and a broadening of the firefighter-rescuer's remit. They sometimes provide emergency medical services. The fire service, or fire and rescue service, also known in some countries as the fire brigade or fire department, is one of the main emergency services.

In many cases, firefighters require telescoping ladders including turntable ladders, tower ladders, tiller ladders, quint ladders, quad ladders, and/or ladders that mount onto hydraulic platforms while performing fire service, and/or fire and rescue services. Preventing injuries from a slip or fall, especially while ascending or descending the telescoping ladders is always desirable.

Applicant believes that one of the closest references corresponds to U.S. Patent Application Publication No. 20100326768 A1, published on Dec. 30, 2010 to Kerstetter, J R. for a fall-arrest ladder system. However, it differs from the present invention because Kerstetter, J R. teaches a safety-featured ladder, including taut rope wrapped over top of the top rung and under bottom of the bottom rung and fixedly connected to the ladder when downward force is applied to the rope in front of the ladder. In a first embodiment, a sleeve including a pulley subsystem is attached to a body harness worn by a climber and can move or slide along the rope only when climbing up ladder. In a second embodiment, a sleeve including a different pulley subsystem including a centrifugal brake is attached to a body harness worn by a climber and can move or slide along the rope when climbing up or climbing down. However, if the climber loses footing and starts to fall the sleeve grabs the rope, and/or the rope grabs the sleeve, which prevents the climber from falling more than a few inches and from injury. Hooks at top of the ladder can hook around transverse cables atop poles.

Applicant believes that another reference corresponds to U.S. Patent Application Publication No. 20100219016 A1, published on Sep. 2, 2010 to Meillet for a fall arrest assembly. However, it differs from the present invention because Meillet teaches a fall arrest assembly that includes a rotational drum, at least one pawl and a catch. The rotational drum is configured to rotate in response to a movement of a lifeline. The least one pawl is in rotational communication with the rotational drum. The at least one pawl is further configured to pivot about a pivot connection in response to select rotational velocities of the rotational drum. The at least one pawl is also configured to engage the catch when the at least one pawl pivots in response to the select rotational velocities of the rotational drum to stop the rotation of the rotational drum and movement of the lifeline. An elastic bushing for each pivot connection is also used. Each elastic bushing is positioned about an associated pivot connection of an associated pawl. The elastic bushings deform in shape as an associated pawl engages the at least one portion of the catch.

Applicant believes that another reference corresponds to U.S. Patent Application Publication No. 20020014370 A1, published on Feb. 7, 2002 to Casebolt, et al. for a fall arrest methods and apparatus with u-joint connector. However, it differs from the present invention because Casebolt, et al. teach a fall arrest device that includes a housing, a braking assembly, and a coupling assembly. The braking assembly cooperates with an elongate support to facilitate controlled movement of the fall arrest device along the elongate support. The coupling assembly is interconnected between the housing and a person to be supported by the device in the event of a fall. The coupling assembly includes a universal joint to accommodate various connection arrangements between the fall arrest device and the person.

Applicant believes that another reference corresponds to U.S. Pat. No. 6,804,830 B1 issued to Reynolds, et al. on Oct. 19, 2004 for a full body harness for fall arrest. However, it differs from the present invention because Reynolds, et al. teach a full body harness, which can include curved webbing, a spreading back pad and/or leg buckles which improve the comfort, use and performance of the harness. Preferably, the harness uses five pieces of webbing, namely, two curved webbing shoulder straps, two identical leg straps, and a sub-pelvic strap. The harness can also have a spreading back pad, which helps to keep the shoulder straps from riding up onto the neck of the wearer.

Applicant believes that another reference corresponds to U.S. Pat. No. 6,260,662 B1 issued to Meister, et al. on Jul. 17, 2001 for a retractable extension for the guiding rail of a climbing guard. However, it differs from the present invention because Meister, et al. teach a device for allowing a person to safely step off from and onto a climbing track on a roof edge, a roof slope, a shaft opening or similar, that includes a guide rail (10) for guiding a catching device to which a person using the climbing path can be secured, and an extension piece (24) of the guide rail (10). The extension piece (24) of the guide rail (10) can be moved between a first and a second position, the extension piece (24) being so arranged in the first position that it does not project above the guide rail (10), and being aligned in longitudinal direction with the guide rail in the second position. The extension piece (24) can be guided displaceable along the guide rail (10) and at a distance from the latter and can be swiveled by 180 degree in the final position, which corresponds to the second position, so that it is in alignment with the extension (10).

Applicant believes that another reference corresponds to U.S. Pat. No. 6,161,647 B1 issued to Braden, et al. on Dec. 19, 2000 for a fall arresting ladder safety device. However, it differs from the present invention because Braden, et al. teach a fall arresting ladder safety device for attachment to a fixed ladder side rail. The fall arresting device is to be used in conjunction with a body harness worn by the climber with a lanyard attached at one end to the body harness and the other end attached to the fall arresting device. The fall arresting device includes first and second arms pivotally connected in an X-configuration with each arm having first and second ladder side rail engaging portions disposed on opposite edges of the ladder side rail. A spring operably attached to the first and second arms biases the first and second arms between a fall arresting position and a climbing position. To ascend or descend the ladder, the handle portion of the first arm is pivoted upward to disengage the ladder side rail engaging portions of the first arm so that the device can be rolled up or down the ladder side rail as the ascends or descends the ladder. The arms of the fall arresting device can be locked into a disengaging position such that the fall arresting device can be removed from the ladder side rail and carried by the climber for later use when descending the ladder or ascending another ladder.

Applicant believes that another reference corresponds to U.S. Pat. No. 5,265,696 B1 issued to Casebolt on Nov. 30, 1993 for a ladder climbing safety clamp. However, it differs from the present invention because Casebolt teaches a ladder climbing safety clamp that may be easily operated by a worker with one hand while overcoming many potential safety hazards of prior devices. The safety clamp includes a body with a U-shaped cable sleeve. A channel is included on one side of the body to permit the introduction of the safety line in the cable sleeve. However, if the cable is too large to operate properly with the safety clamp, it will not fit through the channel, thereby helping to prevent inadvertent usage of the safety clamp with a cable of a diameter for which it is not intended. A gravity stop prevents the safety clamp from being inadvertently installed in an upside-down position, since the safety clamp would not operate correctly in that position.

Applicant believes that another reference corresponds to U.S. Pat. No. 5,161,639 B1 issued to Ice on Nov. 10, 1992 for a derrick counterweight assembly. However, it differs from the present invention because Ice teaches an assembly that has a safety line, which is attached to a harness, which secures to a worker to be used while climbing the ladder of the derrick. Telescoping tube sections are mounted to the derrick for extension and contraction with the derrick sections. The line is trained over a pulley attached to the crown of a derrick, and then passes into the telescoping tube. The line is connected to a counterweight located in the telescoping tube. The line and counterweight remain inside the telescoping tube during rig up and rig down of the derrick.

Applicant believes that another reference corresponds to U.S. Pat. No. 4,458,781 B1 issued to Ellis, et al. on Jul. 10, 1984 for a climbing aid and safety descent device. However, it differs from the present invention because Ellis, et al. teach a controlled descent device, which aids in the ascent of a human being from a lower elevation to an upper elevation and provides for the safe descent of a human being from the upper level to the lower level. The apparatus comprises a round cable, a counterweight, a controlled descent pulley having a ratchet and pawl brake system and a conventional pulley; all operating conjunctly dependently on the position and situation of the human being. The controlled descent pulley and conventional pulley are held in a plate structure, which is secured to the upper elevation. The counterweight is raised and lowered from the upper elevation to the lower elevation and vice-versa by means of a guy wire which is anchored and held in relatively taught position between said upper elevation and said lower elevation.

Applicant believes that another reference corresponds to U.S. Pat. No. 4,252,214 B1 issued to Miller on Feb. 24, 1981 for a safety descent device. However, it differs from the present invention because Miller teaches a fall prevention safety device for attachment to a harness worn by a workman for providing a safely controlled descension rate from an elevated structure includes a cable having one end connected to the harness and strung around a double pulley system having an upper pulley mounted to the elevated structure and a lower pulley mounted to the upper end of a vertically reciprocal plunger which falls substantially unimpeded into a hydraulic cylinder. The cylinder substantially resists upward withdrawal of the plunger. The other cable end is connected to the upper pulley yoke such that during ascent of the workman up the structure, the lower pulley and plunger move downwardly and take up cable slack. If the workman slips and falls at any point during ascent, the cable immediately and automatically provides descension at a controlled rate determined by the resisted withdrawal rate of the plunger as the cable now pulls the lower pulley upward. The hydraulic cylinder includes a bypass line with ports communicating with the hydraulic cylinder at upper and lower compartments above and below the inner plunger end having a seal therearound defining the two compartments. The inner plunger end also carries a one-way valve, which is in an open condition during downward plunger movement and is closed by fluid pressure upon initiation of workman descent.

Applicant believes that another reference corresponds to U.S. Pat. No. 4,111,280 B1 issued to Devine, et al. on Sep. 5, 1978 for a supporting guide rail for ladder safety device. However, it differs from the present invention because Devine, et al. teach a fall prevention safety climbing device for workmen ascending and descending ladders on tall structures comprising a sleeve including a locking pawl adapted for attachment to a workman's safety belt, movable along a continuous supporting guide rail fixed to a ladder and for automatic locking engagement with the supporting rail to arrest a workman's fall. The supporting guide rail at predetermined intervals with notched sections adapts to allow disengagement in a specific safe manner of the otherwise entrapped sleeve and attached climber from the supporting guide rail. Hence, a climber can disembark at the desired platform, or level of the structure to allow another climber to pass on by to another level and thereafter reconnect himself and the attached sleeve to the supporting guide rail.

Applicant believes that another reference corresponds to U.S. Pat. No. 3,598,200 B1 issued to Thompson on Aug. 10, 1971 for an extensible safety appliance for manhole ladders. However, it differs from the present invention because Thompson teaches a sleeve attached to the rungs of a manhole ladder that has a slidable rod therein which is extendable upward from the manhole to provide a vertical railing for workman on the ladder. A support at the lower end of the rod releasably engages a ladder rung to retain the rod in extended position; when unneeded, the rod can is stored wholly within the manhole.

Applicant believes that another reference corresponds to U.S. Pat. No. 2,616,609 B1 issued to Herod on Nov. 4, 1952 for a tower ladder safety device. However, it differs from the present invention because Herod teaches a combination of a ladder equipped with a support carried by the ladder rungs, a sleeve assembly including a main part with attached housed detent and an auxiliary part connected to the main part below the latter in fixed spaced vertical relation thereto, the parts being slidably mounted on said support, the connection between the main part and auxiliary part being constructed to allow relative movement in response to curvatures in the support. The assembly includes connecting means engaged with the detent and with the auxiliary part and engaged with the safety belt of the climber to sustain the climber in the event of casual displacement of the climber from the ladder and to automatically urge the assembly upwardly with the ascent of the climber on the ladder. The tower ladder safety device also comprises a support carried by the ladder, a sleeve assembly slidably engageable with the support including a main bearing part, a substantially completely housed spring pressed detent and an auxiliary bearing part below the main bearing part and attached thereto, and means engaged with said detent and auxiliary bearing part assembly for connection to a person ascending or descending the ladder, the detent being automatically movable into locking engagement with the support in the event of displacement of the person from the ladder.

Other patents describing the closest subject matter provide for a number of more or less complicated features that fail to solve the problem in an efficient and economical way. None of these patents suggest the novel features of the present invention.

SUMMARY OF THE INVENTION

The present invention is a fall restraint system for telescoping ladders. More specifically, the present invention is a fall restraint system having a retractor assembly including a housing assembly that is mounted onto an aerial apparatus. A base pulley assembly is also mounted onto the aerial apparatus. A cable having first and second ends is partially stored within the housing assembly, whereby the first end is fixed within the housing assembly. The second end is threaded around the base pulley assembly and is also fixed onto the aerial apparatus. Tensioning means keep a predetermined tension on the cable while the aerial apparatus extends from a retracted position to an extended position and vice-versa.

It is therefore one of the main objects of the present invention to provide a fall restraint system for telescoping ladders for firefighters to perform fire service, and/or fire and rescue services.

It is another object of this invention to provide a fall restraint system for telescoping ladders, for preventing injuries from a slip or fall, especially while ascending or descending the telescoping ladder.

It is another object of this invention to provide a fall restraint system for telescoping ladders, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
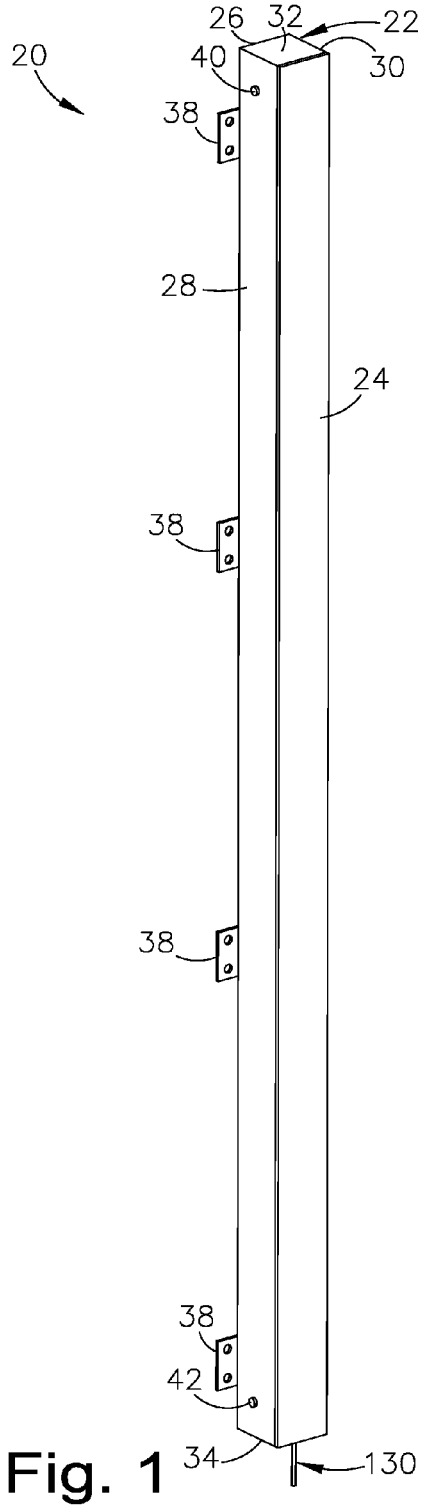
FIG. 1 is an isometric view of a housing assembly of the present invention.

Referring now to the drawings, the present invention is generally referred to with numeral 10. It can be observed that it basically includes retractor assembly 20, base pulley assembly 110, and cable 130.

Figure 2:
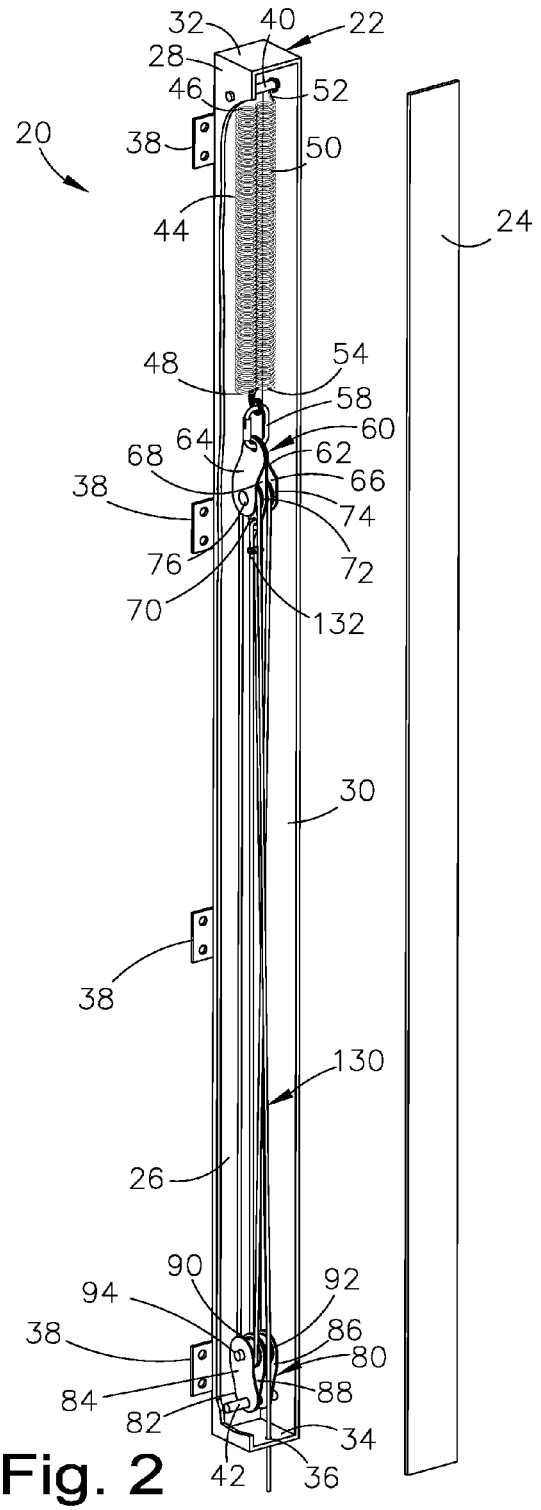
FIG. 2 is an isometric view of a preferred embodiment of the housing assembly, wherein a front wall and one sidewall have been removed to illustrate interior components.

As seen in FIGS. 1 and 2, retractor assembly 20 comprises housing assembly 22. Housing assembly 22 has front wall 24, rear wall 26, sidewalls 28 and 30, top wall 32, and bottom wall 34. Bottom wall 34 has hole 36 for cable 130 to pass through. Cable 130 is therefore partially housed within housing assembly 22. Rear wall 26 has spaced apart anchoring members 38 mounted thereon. At a first predetermined distance from top wall 32, supporting pin 40 is perpendicularly mounted to sidewalls 28 and 30, and at a second predetermined distance from bottom wall 34, supporting pin 42 is also perpendicularly mounted to sidewalls 28 and 30.

Instant invention 10 comprises at least one spring member mounted onto supporting pin 40, and in a preferred embodiment, comprises spring members 44 and 50. Spring members 44 and 50 comprise approximately similar spring force and preferably are positioned parallel to each other within housing assembly 22. In this embodiment, spring members 44 and 50 can be tension springs. Spring member 44 has ends 46 and 48, and spring member 50 has ends 52 and 54. Ends 46 and 52 of spring members 44 and 50 respectively are secured to supporting pin 40. The at least one spring member mounted onto supporting pin 40, comprising spring members 44 and 50 therefore are tensioning means to keep a predetermined tension on cable 130 while the aerial apparatus extends from a retracted position to an extended position and vice-versa.

Secured to ends 48 and 54 and pulley assembly 60 is clip 58. In the preferred embodiment, pulley assembly 60 is a pulley system with shackle 62 having sidewalls 64 and 66, and intermediate wall 68. Intermediate wall 68 has becket 70. Pulley 72 is sandwiched between sidewall 64 and intermediate wall 68. Pulley 74 is sandwiched between intermediate wall 68 and sidewall 66. Pulleys 72 and 74 rotate upon pin 76.

Pulley assembly 80 is mounted to supporting pin 42 in an inverted orientation with respect to pulley assembly 60. Pulley assembly 80 is also a pulley system with shackle 82 having sidewalls 84 and 86, and intermediate wall 88. Pulley 90 is sandwiched between sidewall 84 and intermediate wall 88. Pulley 92 is sandwiched between intermediate wall 88 and sidewall 86. Pulleys 90 and 92 rotate upon pin 94.

As best seen in FIG. 2, cable end 132 is secured to becket 70. Cable 130 may be threaded to optimize pulley assemblies 60 and 80 in different ways. In this illustration, from becket 70, cable 130 is threaded around pulley 92, then pulley 74, then pulley 90, then pulley 72 to finally exit housing assembly 22 through hole 36.

Figure 3:
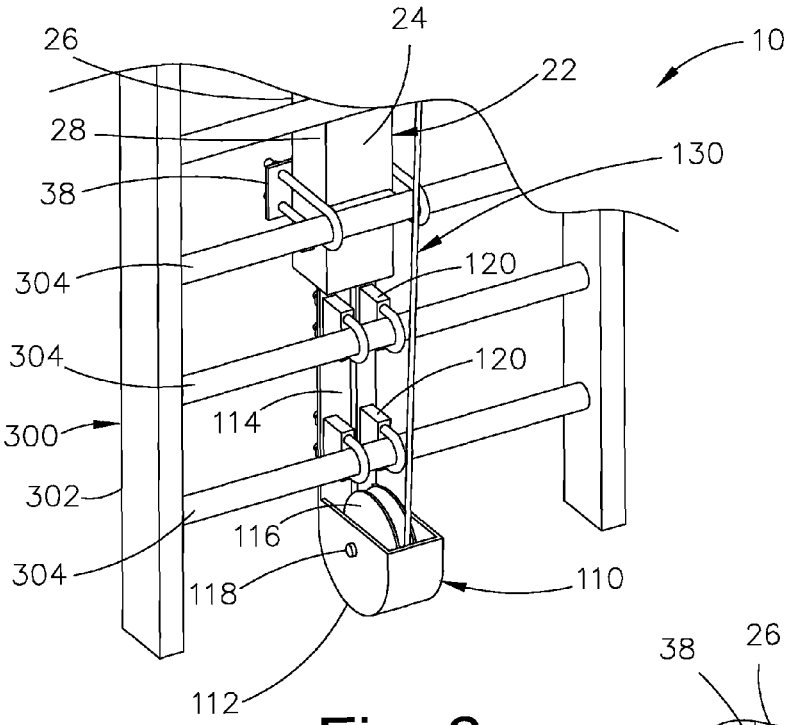
FIG. 3 is an isometric view of a preferred embodiment of a base pulley assembly mounted onto a base section of a ladder assembly.
Figure 4:
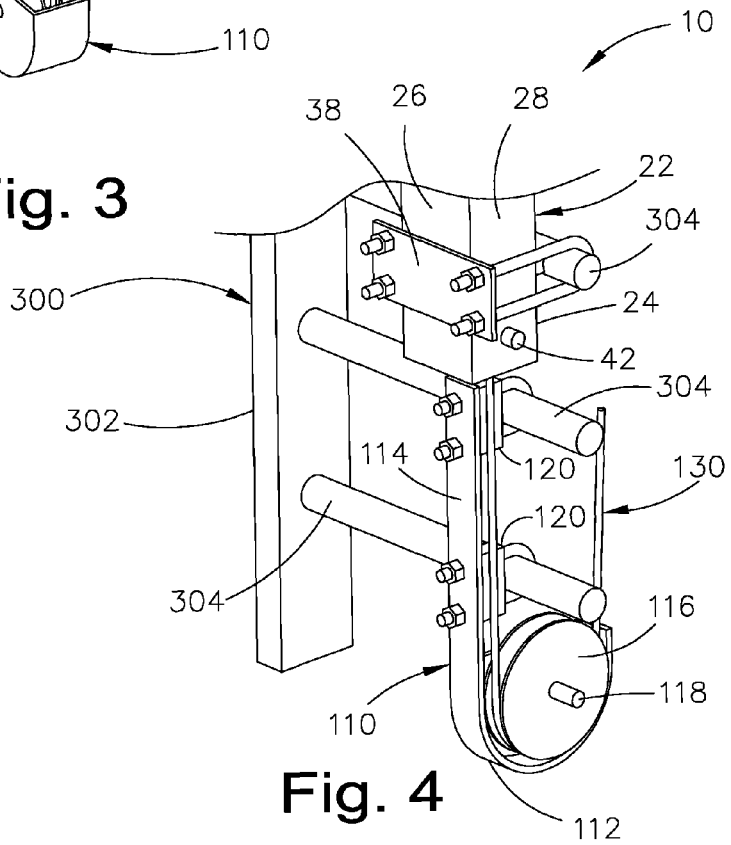
FIG. 4 is an isometric view of the base pulley assembly seen in FIG. 3, cross-sectioned to illustrate interior components.

As seen in FIGS. 3 and 4, base pulley assembly 110 comprises housing 112 having rear wall 114. Pulley 116 rotates upon pin 118 that is perpendicularly mounted to sidewalls of housing 112. Rear wall 114 has anchoring members 120 for securing base pulley assembly 110 to lower rungs 304 of base section 302. Base pulley assembly 110 changes a direction of cable 130 approximately 180 degrees when cable 130 is threaded around pulley 116.

Figure 5:
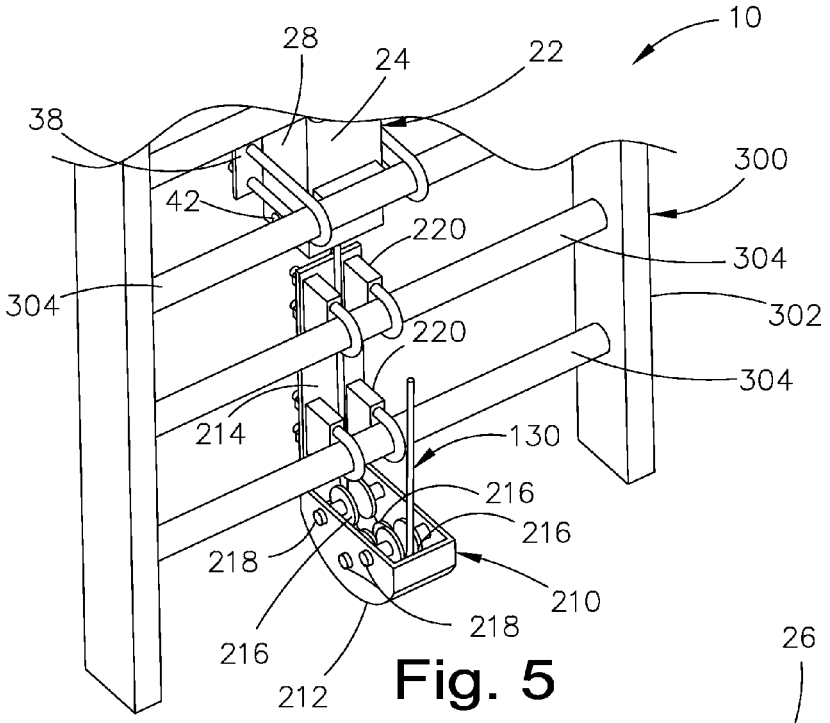
FIG. 5 is an isometric view of an alternate embodiment of the base pulley assembly mounted onto the base section of the ladder assembly.
Figure 6:
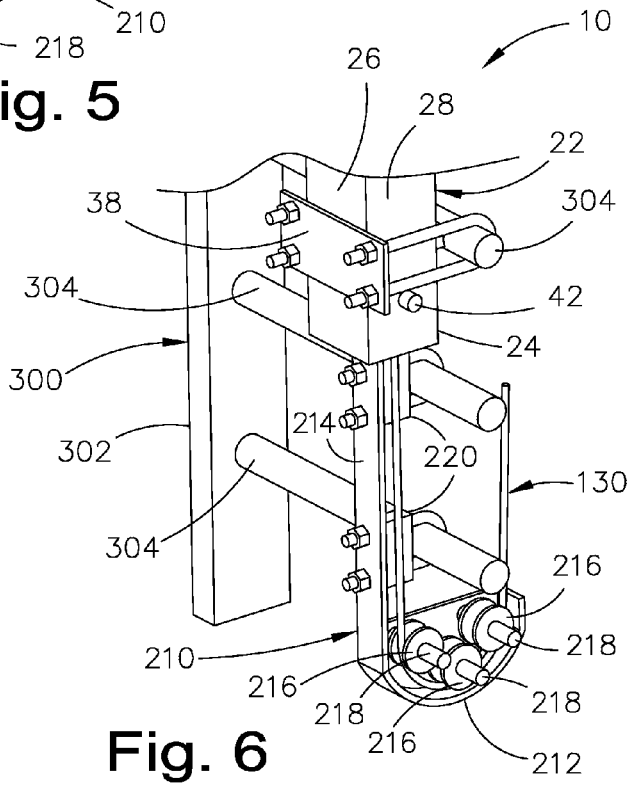
FIG. 6 is an isometric view of the base pulley assembly seen in FIG. 5, cross-sectioned to illustrate interior components.

As seen in FIGS. 5 and 6, base pulley assembly 210 is an alternate embodiment of base pulley assembly 110. Base pulley assembly 210 comprises housing 212 having rear wall 214. Pulleys 216 rotate upon respective pins 218 that are perpendicularly mounted to sidewalls of housing 212. Rear wall 214 has anchoring members 220 for securing base pulley assembly 210 to lower rungs 304 of base section 302. Base pulley assembly 210 changes a direction of cable 130 approximately 180 degrees when cable 130 is threaded around pulleys 216.

Figure 7:
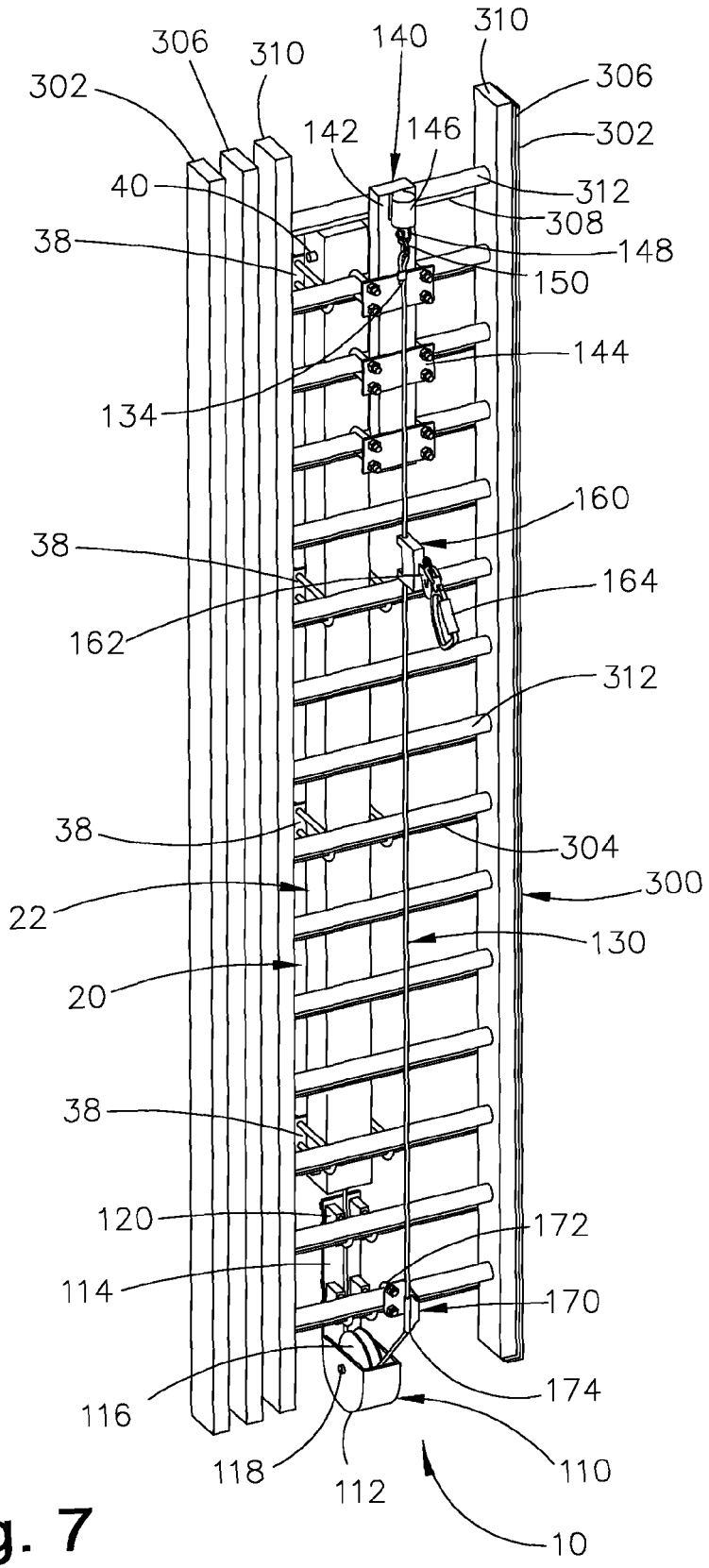
FIG. 7 is an isometric view of the fall restraint system, object of the present invention, mounted onto a telescoping ladder in a retracted position.
Figure 8:
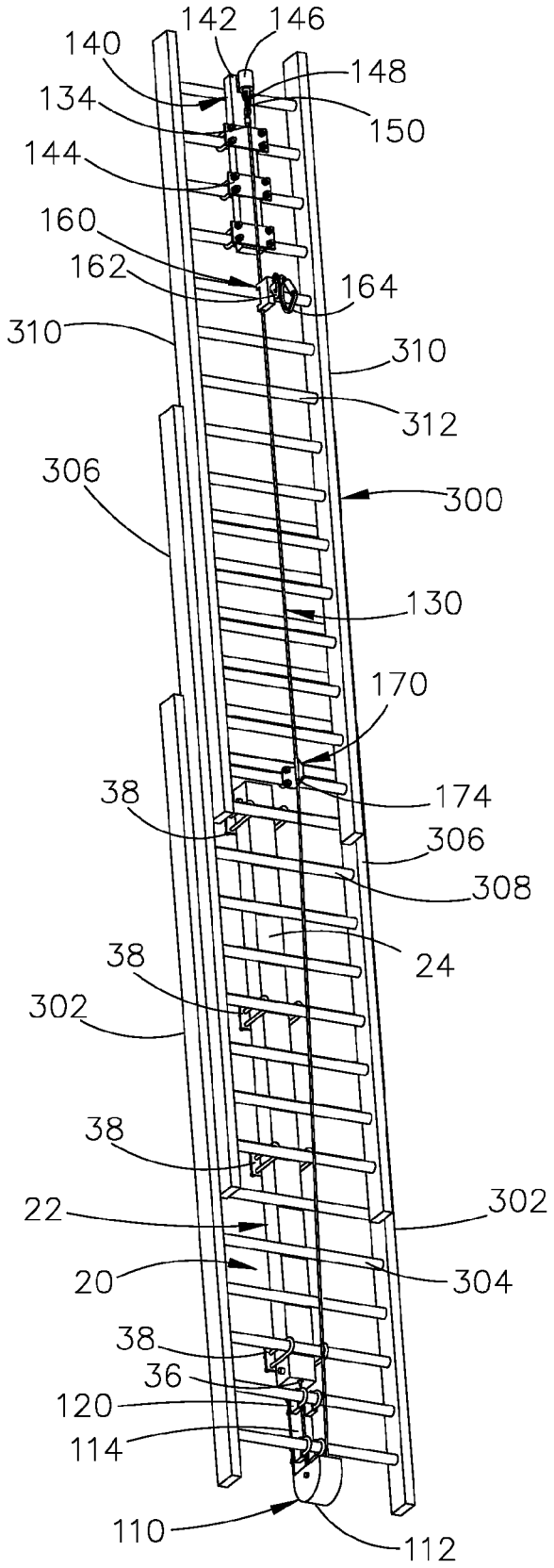
FIG. 8 is an isometric view of the fall restraint system, object of the present invention, mounted onto the telescoping ladder in an extended position.

As seen in FIGS. 7 and 8, instant invention 10 is a fall restraint system that mounts onto an aerial apparatus such as ladder assembly 300. In many cases, firefighters require telescoping ladders to perform fire service, and/or fire and rescue services. Preventing injuries from a slip or fall, especially while ascending or descending the telescoping ladders is always desirable. Aerial apparatuses can be any multi-sectioned telescoping ladders such as ladder assembly 300. Aerial apparatuses further include, but are not limited to: turntable ladders, tower ladders, tiller ladders, quint and/or quad ladders, and hydraulic platforms.

A turntable ladder is perhaps the best-known form of specialized aerial apparatus, and is used to gain access to fires occurring at height using a large telescopic ladder such as ladder assembly 300, where conventional ladders carried on conventional appliances might not reach. The name is derived from the fact that the large ladder is mounted on a turntable on the back of a truck chassis, allowing it to pivot around a stable base, which in turn allows a much greater ladder length to be achieved. To increase its length, the ladder is telescopic. Modern turntable ladders are either hydraulic or pneumatic in operation. A ladder can also be mounted behind a cab. This is sometimes called "mid-ship" and the arrangement allows a shorter wheelbase for a truck, and also can be more stable in some conditions. Rear-mount ladders are built on wheelbases as short as 8 ft 10 in. Examples are 60 ft units manufactured by Gimaex Group. The key functions of a turntable ladder are: allowing access or egress of firefighters at height; providing a high level water point for firefighting (elevated master stream); and providing a working platform from which tasks such as ventilation or overhaul can be executed. Furthermore, many modern turntable ladders have a water pumping function built in (and some have their own onboard supply reservoir), and may have a pre-piped waterway running the length of the ladder, to allow a stream of water to the firefighters at the top. In some cases, there may also be a monitor at the top of the ladder for ease of use. Other appliances may simply have a trackway, which will hold a manually run hose reel securely, and prevent it from falling to the ground.

Some turntable ladders may have a basket (sometimes known as a bucket) mounted at the top of the ladder, as on a hydraulic platform; these are called tower ladders. These appliances can provide a secure place for a firefighter to operate equipment from, and allow multiple people, including rescued persons, to be carried.

A tiller ladder, also known as a tractor-drawn aerial or hook-and-ladder truck, is a specialized turntable ladder mounted on a semi-trailer truck. It has two drivers with separate steering wheels for front and rear wheels. This truck is primarily used in the United States, especially in areas with narrow streets that prevent longer rigid-bodied trucks from entering such as San Francisco and Washington, D.C. The hook-and-ladder concept started when taller skyscrapers and more city streets became a problem for fire departments. Larger ladders were needed to get to the upper stories of buildings, and the only way to move them was in this format. The independent steering for the rear wheels improves maneuverability and allows the truck to quickly position itself when fighting fires.

In some areas of the United States, the turntable ladder may be known as a quint or quad, as it is capable of performing multiple tasks (pump, water tank, fire hose, aerial device, and ground ladders) with each of these functions making up one of its four (Quad) or five (Quint) capabilities. The National Fire Protection Association ("NFPA") has certain specification that a turntable ladder has to meet to be officially considered a quint or quad (such as fire pump capacity, minimum amounts of equipment, etc.).

A hydraulic platform, also known as articulating booms, Snorkels, platform trucks, Bronto (used in Australia) or sometimes shortened to just HP, is a specialized aerial work platform designed for firefighting use. They have a number of functions, which follow the same principles as the turntable ladder, providing high-level access and elevated water pump positions. Some hydraulic platforms are articulated, which allows an arm to bend in one or more places, giving it the ability to go "up and over" an obstacle (such as a building roof). There are non-articulated platforms, based on standard aerial work platforms, although the most common type is the tower ladder (mentioned above). HPs (articulated or not) may still have a ladder arrangement fitted to the arm, such as ladder assembly 300, primarily as an emergency measure. In some jurisdictions these can be denoted ladder platforms. Most HPs are designed to reach a height of around 33 meters (100 feet), although larger models are capable of reaching heights of over 100 meters (328 feet). Many HPs are fitted with additional equipment in the platform itself, which can include a control panel, lighting equipment, a fixed water outlet or monitor, power outlets or compressed air outlets (allowing the fixing of rescue equipment, such as hydraulic rescue tools). Many are also adapted or capable of carrying a stretcher. Some units have video systems and remote control in case of dangerous chemical fires.

As seen in FIGS. 7 and 8, ladder assembly 300 comprises base section 302 having lower rungs 304, mid-section 306 having rungs 308, and fly section 310 having rungs 312. In the preferred embodiment, ladder assembly 300 is a turntable ladder, tower ladder, tiller ladder, quint ladder, quad ladder, or one that mounts onto a hydraulic platform as defined above. In addition, instant invention 10 may also mount onto other aerial apparatuses with compatible configurations as of the turntable ladder, tower ladder, tiller ladder, quint ladder, quad ladder, or one that mounts onto a hydraulic platform as defined above.

In a preferred embodiment, ladder assembly 300 comprises at least one stationary guide 170 typically mounted at rungs 312 of fly section 310 with anchoring member 172. Extending forward from stationary guide 170 is rail 174. Cable 130 is threaded through rail 174.

Also mounted at rungs 312 of fly section 310 is anchor assembly 140, comprising supporting post 142 with anchoring members 144. Anchor 146 is rigidly mounted to an upper end of supporting post 142. Anchor 146 comprises lock 148 and clip 150 has cable end 134 secured thereto.

Fall protection clamp assembly 160 has clamp 162 and slidably engages upon cable 130. Clip 164 is mounted to clamp 162.

Depending on a fire service, and/or fire and rescue services to be performed, ladder assembly 300 may need to extend from a retracted position, as seen in FIG. 7, to an extended position as seen in FIG. 8. While extending from the retracted position, cable end 134 remains stationary at lock 148, whereby clip 150 keeps cable end 134 secured thereto. Cable 130 is therefore drawn from retractor assembly 20, overcoming the spring force of spring members 44 and 50, as ladder assembly 300 is extending from the retracted position, seen in FIG. 7, to the extended position seen in FIG. 8. It is noted that housing assembly 22 is sufficiently long to permit spring members 44 and 50 to extend therein for full extension of ladder assembly 300. Once ladder assembly 300 is at a desired height, clip 164 is attached to a body harness worn by a climber, not seen, to enable the climber to safely ascend and descend ladder assembly 300. It is noted that clip 164 will be positioned at base section 302 to enable the climber to secure onto clip 164 without having to ascend ladder assembly 300. In FIG. 8, fall protection clamp assembly 160 is shown below anchor assembly 140 to illustrate that it slidably engages upon cable 130. It is also noted that the spring force of spring members 44 and 50 is sufficient to keep proper and constant tension upon cable 130, especially to enable the climber to safely ascend and descend ladder assembly 300. Cable 130 recoils into retractor assembly 20 as ladder assembly 300 retracts from the extended position seen in FIG. 8, to the retracted position seen in FIG. 7.

Figure 9:
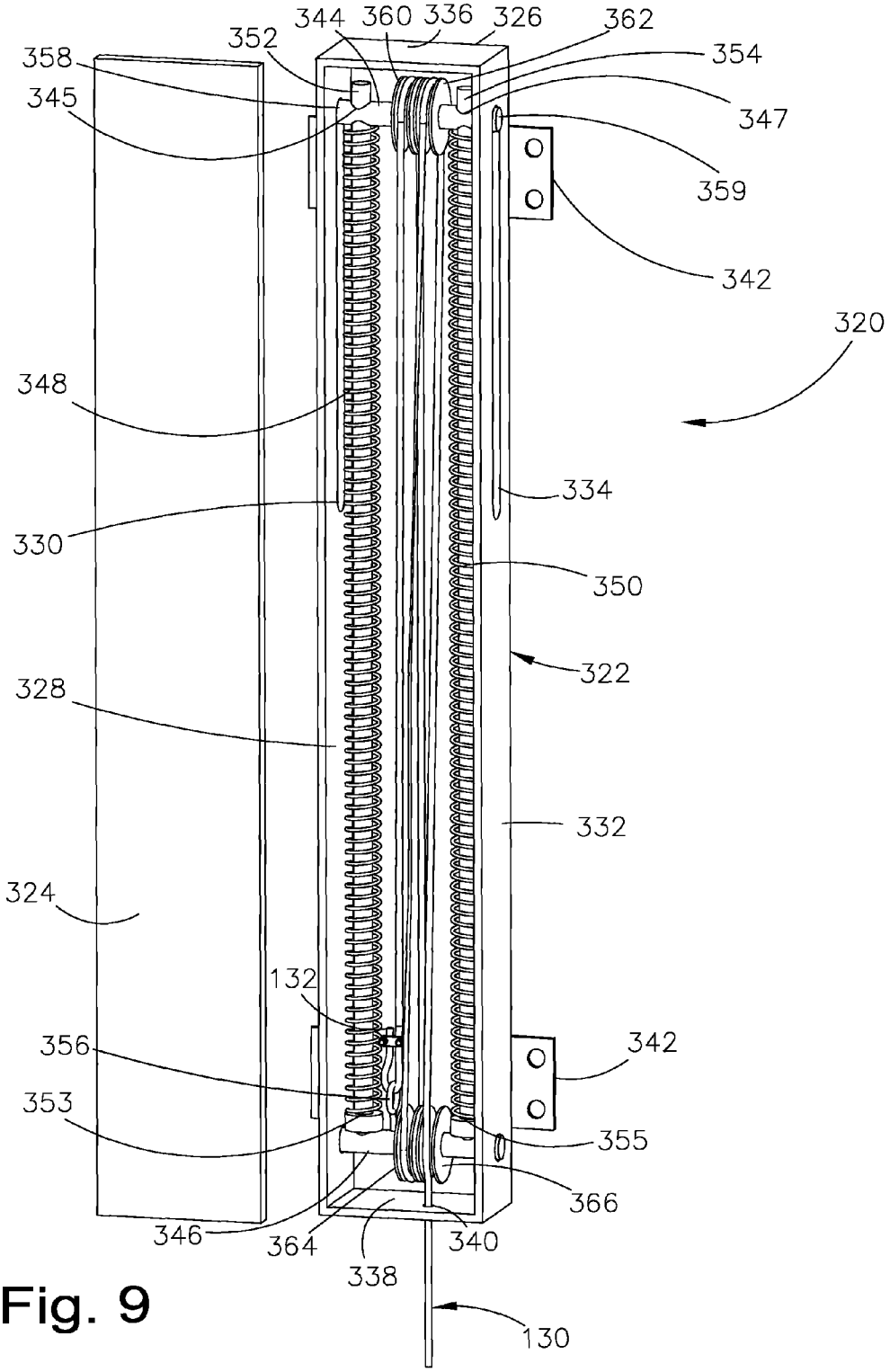
FIG. 9 is an isometric view of an alternate embodiment of the housing assembly, wherein a front wall has been removed to illustrate interior components.

Seen in FIG. 9 is an alternate embodiment of the housing assembly, whereby retractor assembly 320 comprises housing assembly 322. Housing assembly 322 has front wall 324, rear wall 326, sidewalls 328 and 332, top wall 336, and bottom wall 338. Sidewalls 328 and 332 have slots 330 and 334, respectively, extending from a predetermined distance from top wall 336 towards bottom wall 338 without reaching bottom wall 338. Journaling pin 344 journals within slots 330 and 334, and has ends 358 and 359 that protrude from slots 330 and 334, respectively. Journaling pin 344 also has holes 345 and 347 transversally and vertically disposed at a predetermined distance from ends 358 and 359 to receive shafts 352 and 354 respectively. It is noted that shafts 352 and 354 are fixed at holes 345 and 347. Supporting pin 346 is perpendicularly mounted to sidewalls 328 and 332. Bottom wall 338 has hole 340 for cable 130 to pass through, and rear wall 326 has spaced apart anchoring members 342 mounted thereon.

Additionally, retractor assembly 320 comprises at least one spring member mounted upon a shaft, and in a preferred embodiment, comprises spring members 348 and 350 mounted upon shafts 352 and 354 respectively. Shafts 352 and 354 may have bushings 353 and 355 respectively. Spring members 348 and 350 comprise approximately similar spring force and preferably are positioned parallel to each other within housing assembly 322. In this embodiment, spring members 348 and 350 can be compression springs. The at least one spring member mounted upon a shaft, comprising spring members 348 and 350 mounted upon shafts 352 and 354 respectively, therefore are tensioning means to keep a predetermined tension on cable 130 while the aerial apparatus extends from a retracted position to an extended position and vice-versa.

Retractor assembly 320 further comprises clip 356 and pulleys 360, 362, 364, and 366. Clip 356 is fixed to supporting pin 346 to secure cable end 132. Pulleys 360 and 362 are rotatably mounted to journaling pin 344, and pulleys 364 and 366 are rotatably mounted to supporting pin 346.

Cable 130 may be threaded to optimize the pulley assemblies having pulleys 360, 362, 364, and 366 in different ways. In this illustration, from clip 356, cable 130 is threaded around pulley 360, then pulley 364, then pulley 362, then pulley 366 to finally exit housing assembly 322 through hole 340.

Depending on a fire service, and/or fire and rescue services to be performed, ladder assembly 300 may need to extend from a retracted position, as seen in FIG. 7, to an extended position as seen in FIG. 8. While extending from the retracted position, cable end 134 remains stationary at clip 356 secured thereto. Cable 130 is therefore drawn from retractor assembly 320, overcoming the spring force of spring members 348 and 350, as ladder assembly 300 is extending from the retracted position, seen in FIG. 7, to the extended position seen in FIG. 8. It is noted that housing assembly 322, and slots 330 and 334, are sufficiently long to permit spring members 348 and 350 to compress within housing assembly 322 for full extension of ladder assembly 300. Once ladder assembly 300 is at a desired height, clip 164 is attached to a body harness worn by a climber, not seen, to enable the climber to safely ascend and descend ladder assembly 300. It is noted that clip 164, will be positioned at base section 302 to enable the climber to clip onto clip 164 without having to ascend ladder assembly 300. In FIG. 8, fall protection clamp assembly 160 is shown below anchor assembly 140 to illustrate that it slidably engages upon cable 130. It is also noted that the spring force of spring members 348 and 350 is sufficient to keep proper and constant tension upon cable 130, especially to enable the climber to safely ascend and descend ladder assembly 300. Cable 130 recoils into retractor assembly 320 as ladder assembly 300 retracts from the extended position seen in FIG. 8, to the retracted position seen in FIG. 7.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fall restraint system, comprising:

A) a retractor assembly having a housing assembly mounted onto an aerial apparatus, said housing assembly comprising first and second sidewalls, said housing assembly further comprising a journaling pin and a supporting pin mounted to said first and second sidewalls, said first and second sidewalls comprising respective first and second slots, said journaling pin configured to slide within said first and second slots;

B) a base pulley assembly;

C) a cable having first and second ends, said cable partially stored within said housing assembly, whereby said first end is fixed within said housing assembly, said second end is threaded around said base pulley assembly and is fixed onto said aerial apparatus; and D) tensioning means to keep a predetermined tension on said cable while said aerial apparatus extends from a retracted position to an extended position and vice-versa; said tensioning means comprises first and second spring members; said first and second spring members are mounted onto first and second shafts respectively.

2. The fall restraint system set forth in claim 1, further characterized in that said aerial apparatus is a telescoping ladder.

3. The fall restraint system set forth in claim 1, further characterized in that said aerial apparatus is a turntable ladder, tower ladder, tiller ladder, quint ladder, quad ladder, or a hydraulic platform.

4. The fall restraint system set forth in claim 1, further characterized in that said base pulley assembly is mounted onto a base section of said aerial apparatus.

5. The fall restraint system set forth in claim 1, further characterized in that said base pulley assembly is mounted onto rungs of a base section of said aerial apparatus.

6. The fall restraint system set forth in claim 1, further characterized in that said second end is fixed onto a fly section of said aerial apparatus.

7. The fall restraint system set forth in claim 1, further comprising at least one stationary guide positioned between said base pulley assembly and said second end fixed onto a fly section of said aerial apparatus.

8. The fall restraint system set forth in claim 1, further characterized in that said first and second spring members, each having a spring force, wherein said cable is drawn from said housing assembly overcoming said spring force as said aerial apparatus extends from said retracted position to said extended position.

9. The fall restraint system set forth in claim 8, further characterized in that said housing assembly is sufficiently long to permit said first and second spring members to compress therein for full extension of said aerial apparatus.

10. The fall restraint system set forth in claim 8, further characterized in that said housing assembly further comprises a front wall, a rear wall, a top wall, and a bottom wall.

11. The fall restraint system set forth in claim 10, further characterized in that said first and second spring members are mounted onto first and second shafts respectively extending between said journaling pin and said supporting pin.

12. The fall restraint system set forth in claim 1, further characterized in that said first and second spring members, each having a spring force, wherein said cable recoils into said housing assembly as said aerial apparatus retracts from said extended position to said retracted position.

13. The fall restraint system set forth in claim 1, further characterized in that said housing assembly comprises anchoring members to secure said housing assembly upon said aerial apparatus.

14. The fall restraint system set forth in claim 1, further characterized in that said base pulley assembly comprises a housing and at least one pulley mounted upon a respective pin.

15. The fall restraint system set forth in claim 14, further characterized in that said housing comprises anchoring members to secure said housing upon said aerial apparatus.

* * * * *